US005232577A

United States Patent [19]

Fetzer et al.

[11] Patent Number: 5,232,577

[45] Date of Patent: Aug. 3, 1993

[54] HYDROCRACKING PROCESS WITH POLYCYCLIC AROMATIC DIMER REMOVAL

[75] Inventors: John C. Fetzer, Hercules; John M. Rosenbaum, Richmond; Robert W. Bachtel, El Cerrito; Dennis R. Cash, Novato; David G. Lammel, Orinda, all of Calif.

[73] Assignee: Chevron Research and Technology Company, San Francisco, Calif.

[21] Appl. No.: 567,427

[22] Filed: Aug. 14, 1990 (Under 37 CFR 1.47)

[51] Int. Cl.[5] ..... C10G 64/04

[52] U.S. Cl. ..... 208/96; 208/48 AA; 208/311

[58] Field of Search ..... 208/96, 311, 48 R, 48 AA

[56] References Cited

U.S. PATENT DOCUMENTS

| | | | |
|---|---|---|---|
| 3,546,098 | 12/1970 | Spars | 208/96 |
| 3,562,145 | 2/1971 | Franz | 208/96 |
| 3,579,437 | 4/1969 | Wentzheimer | 208/96 |
| 3,619,407 | 11/1971 | Hendricks et al. | 208/48 R |
| 3,660,273 | 5/1972 | Cummins | 208/96 |
| 3,781,196 | 12/1973 | Thompson | 208/96 |
| 3,925,220 | 12/1975 | Mills | 208/14 |
| 3,929,617 | 12/1975 | Henry et al. | 208/96 |
| 4,411,768 | 10/1983 | Unger et al. | 208/59 |
| 4,447,315 | 5/1984 | Lamb et al. | 208/99 |
| 4,655,903 | 4/1987 | Rahbe et al. | 208/96 |
| 4,676,886 | 6/1987 | Rahbe et al. | 208/96 |
| 4,853,104 | 8/1989 | Degnan, Jr. et al. | 208/96 |

OTHER PUBLICATIONS

Noor Mohammed Abdul Latif, "Polynuclear Aromatic Formation in Hydrocracker and Their Impact on Catalyst Stability." Mar. 1989.

*Primary Examiner*—Helane Myers
*Attorney, Agent, or Firm*—V. J. Cavalieri

[57] ABSTRACT

A process for separation and removal of stable polycyclic aromatic dimer foulants from refinery process streams by blending a paraffinic stream with a portion of heavy effluent from a hydrocracking reactor to induce precipitation of foulant, which may then be separated and removed from the hydrocracker. Additional embodiments include introduction of flocculating agents and adjusting the temperature of the blend.

24 Claims, 2 Drawing Sheets

HYDROCRACKING PROCESS WITH POLYCYCLIC AROMATIC DIMER REMOVAL

BACKGROUND OF THE INVENTION

The present invention relates to the removal of compounds from petroleum refinery streams which foul process equipment. More specifically, it relates to a process for separating stable polycyclic aromatic compounds which form during the hydrocracking process and which foul downstream process equipment by scaling and plugging flow in and around such downstream equipment.

Petroleum refinery hydrocracking processes are well known and developed. Such processes upgrade mixtures of hydrocarbons to supply more valuable product streams.

Hydrocracking is a high severity hydrotreating operation in which high molecular weight compounds are cracked to lower boiling materials. Severity is increased by operating at higher temperature and longer contact time than in hydrotreating. Increased hydrogen pressure controls deposits and catalyst fouling. Unlike thermal or catalytic cracking, hydrocracking decreases the molecular weight of aromatic compounds and fills a specific need for processing streams high in aromatic material, such as cycle stocks from catalytic or thermal cracking, coker products, or coal liquids. For example, catalytic cycle stock can be cracked to a naphtha fraction that is an excellent feed for catalytic reforming to make premium-octane gasoline or petrochemical aromatic material.

Hydrocracking us used extensively on distillate stocks. The hydrocracking process is applied to refinery stocks for premium-quality kerosene and diesel or jet fuels low in sulfur and nitrogen. The light products from hydrocracking are also rich in isobutane, an important raw material for alkylation.

Hydrocracking is of increasing importance in view of the trend to heavier crudes and the need for processing synthetic crudes. Thus, hydrocracking of residuum, tar sands, and shale oil of 10–11% hydrogen content may be more attractive than upgrading coil liquids with only 6% hydrogen and high aromatic content.

In recent times, as the worldwide supply of light, sweet crude oil for refinery feedstock has become more scarce, there has been a significant trend toward conversion of higher boiling compounds to lower boiling ones. This "bottom of the barrel" or "hard processing" has increased potential downstream fouling problems by tending to create even greater quantities of heavier, converted cyclic compounds, such as polycyclic aromatics, in the initial stages of the refining process. The addition of a hydrocracking reactor, and such process units as residual desulfurization units, makes the need for an economic solution to the fouling problem even more desired.

As demand for distillate fuels increased, refiners installed hydrocrackers to convert Vacuum Gas Oil (VGO) to jet and diesel. Catalysts were developed that exhibited excellent distillate selectively, high conversion activity and stability for heavier feedstocks.

A trend in recent years in the push for higher yielding reactors has been the use of longer life catalysts having an increasing amount of molecular sieve. A well known class of catalysts with a higher degree of molecular sieve are the "zeolite" type catalysts. One result of the zeolitic catalyst in hydrocracking reactors is the formation of aromatic compounds, which in turn once again increases the presence of compounds having a propensity to form stable polycyclic aromatic compounds. Additionally, these stable polycyclic aromatic compounds contribute to catalyst fouling and cooling. The formation of stable polycyclic aromatic dimer compounds has been found to increase during "end of run" conditions just prior to catalyst replacement, when hydrocracker temperatures may approach 850°–900° F. Thus, an efficient and economical improved process for the removal of stable polycyclic aromatic compounds is much desired as a means for reducing fouling of refinery process equipment and catalyst coking.

In addition to high conversion distillate production, another trend in the 1980's has been to send unconverted fractionator bottoms from the hydrocracker to units such as FCC units, ethylene crackers and lube plants which benefit from highly paraffinic feedstocks. The VGO-range bottoms material is desulfurized, denitrified and highly saturated during its residence time in the hydrocracker.

U.S. Pat. No. 3,619,407 issued on Nov. 9, 1971 to Hendricks et al. describes one hydrocracking catalyst for use in a hydrocracking process, and is further relevant in describing certain aspects of the problem which is addressed by the present invention. The reference discloses the problem of the formation of polycyclic aromatic compounds which are identified in the reference as being benzocorenene. The reference describes the known tendency for such compounds to "plate out" onto cooler downstream equipment such as heat exchanger surfaces. The claimed solution described in the reference is the withdrawal or "bleeding" of a portion of the hydrocracker effluent, in order to reduce the concentration of polycyclic aromatics existing in such effluent.

U.S. Pat. No. 4,447,315 issued on May 8, 1984 to Lamb et al. is considered relevant for disclosing a process scheme for reducing the concentration of polynuclear aromatic compounds, or "PNA's" in a hydrocracking process by separating hydrocracker effluent in a fractionator, and contacting the fractionator bottoms in an adsorption unit with an adsorbent which selectively retains the PNA compounds, and recycling the fractionator bottoms back to the hydrocracking reactor.

U.S. Pat. No. 4,655,903 issued on Apr. 7, 1989 to Rahbe et al. discloses a method of upgrading residuals by removing unstable polynuclear hydrocarbons known to be coke precursors by mixing with the residual a light hydrocarbon solvent, and separating polynuclear hydrocarbons from the unconverted residual.

BRIEF SUMMARY OF THE INVENTION

In accordance with the present invention, a process for removing stable polycyclic aromatic dimers from hydrocarbonaceous refinery streams is provided. The process comprises the steps of:

(a) feeding a hydrocarbon stream to a hydrocracking reactor to produce a light stream and a heavy effluent stream;

(b) contacting at least a portion of the heavy effluent stream with a light paraffinic stream to produce a blended stream which contains a stable polycyclic aromatic dimer precipitate; and (c) separating and then withdrawing the precipitate containing polycyclic aromatic dimer from the blended stream while the hydrocracker is on-stream.

Having the knowledge of the specie or species of polycyclic aromatic dimer present in the system, and which is sought to be precipitated, is of significance in the present invention. Among other factors, the present invention is based upon our finding that fouling compounds present in the problematic hydrocarbon refinery streams are predominantly dicoronylene, coronylovalene, diovalylene, or mixtures thereof. These are stable compounds as compared to relatively unstable polynuclear aromatics, or unstable "PNA's". The dimerization reaction we now have determined to be dominant is depicted in FIG. 1. Prior to this discovery, it was believed that the foulants were compounds of lesser molecular weight such as coronene and benzocoronene. Knowledge of the fouling compounds allows for their controlled precipitation and removal from otherwise valuable hydrocarbon streams during normal on-stream refinery operations.

Though applicable to any refinery stream which may contain stable polycyclic aromatic dimer, we have found the present invention particularly applicable to treating hydrocracking reactor effluents, more particularly effluents produced where the hydrocracker feedstock is a vacuum gas oil, and even further where the vacuum gas oil has been contacted with a catalyst, such as in a residual desulfurization (RDS) process, prior to entering the hydrocracking reactor. This invention is also particularly applicable to hydrocracker feedstocks such as resid-derived vacuum gas oils, coker gas oils and FCC cycle oils, especially those derived from FCC units feeding resid.

We have found the present process to be advantageous in treating effluent streams from fixed-bed reactors, though not so limited.

To aid in the controlled precipitation of the stable polycyclic aromatic dimer foulants from hydrocracking reactor effluent streams, we have found the addition of a light paraffinic stream to be advantageous. Further, it was found that the amount and temperature of the added paraffinic stream and the resultant temperature of the blended stream are important.

A further embodiment of the present invention incorporates the addition of a flocculating agent to aid in controlled precipitation of the foulant compounds. Vinyl acetate copolymer and carboxylate-terminated polystyrene are preferred flocculating agents which may be added in a mass-ratio of between 100:1 and 20:1 in relation to the foulant polycyclic aromatic dimer compounds precipitating from the blended stream.

Once controlled precipitation is effected in the blended stream, separation and withdrawal of the precipitated foulant stable polycyclic aromatic dimer compounds from the blended stream is necessary, prior to the foulant free blended stream contacting downstream process equipment. In a preferred embodiment of the present invention, separation is accomplished through filtration, although settling or the use of centrifugation, such as by employing a centrifugal decanter, are also suitable.

An important aspect of the present invention is that only a very small portion of the valuable hydrocracking reactor effluent is removed, as opposed to prior known methods which called for systematic withdrawal or "bleeding" of material from the hydrocracker recycle loop for the sole purpose of reducing the concentration of suspected contaminants. A further important aspect of the present invention is that it acts upon the foulant polycyclic aromatic dimers themselves, not dimer precursors such as coronene or ovalene, thus allowing lighter aromatics to be cracked to additional products, avoiding the excessive bleeding to less valuable streams such as fuel oil, and remain in more valuable streams for possible reforming and blending.

DETAILED DESCRIPTION OF THE PREFERRED EMBODIMENTS

As used herein, the term "hydrocracking" means a process consuming hydrogen and converting a hydrocarbonaceous stream, such as a petroleum fraction, to a hydrocarbon product. Example feedstreams to a hydrocracking reactor include gas oil, heavy oil, reduced crude, and vacuum distillation residua. The hydrocracking reaction effluents are generally a two-phase mixture of liquid and gases, where the principal components of the liquid phase of the effluent are $C_5$ and higher hydrocarbons.

The term "polycyclic aromatic dimer" or "PAD" is used here to connote stable dimerized compounds, not tending to further react or dimerize, resulting from the Scholl condensation of molecules resulting from one ring additions to naphthalene. Examples are dicoronylene, coronylovalene, diovalene, which result from the School condensation of coronene, ovalene or both.

The term "flocculant" is used here to connote oil soluble organic compounds which are added alone or in combination to induce or enhance precipitation of dissolved compounds in a hydrocarbon stream.

The term "paraffinic stream" is used to connote a liquid stream having a predominance of saturated hydrocarbons, preferably straight chain or n-paraffinic saturated hydrocarbons therein. Useful paraffinic streams include light straight run gasolines, refinery streams previously subjected to one or more processing unit operations, or $C_3$–$C_5$ hydrocarbon streams. Alternatively, paraffinic streams can be imported into the refinery process from an outside source.

Referring to FIG. 5, a feed is introduced via line 1, and may be a hydrocarbonaceous feed typical for hydrocracking. Preferred feeds are vacuum gas oil boiling from about 500°–1000°πF. and gas oils boiling from a bout 400°–1000° F. The present process is especially advantageous when applied to hydrocracker feeds which are vacuum gas oil boiling around 650°–1100° F.

Figure 1:
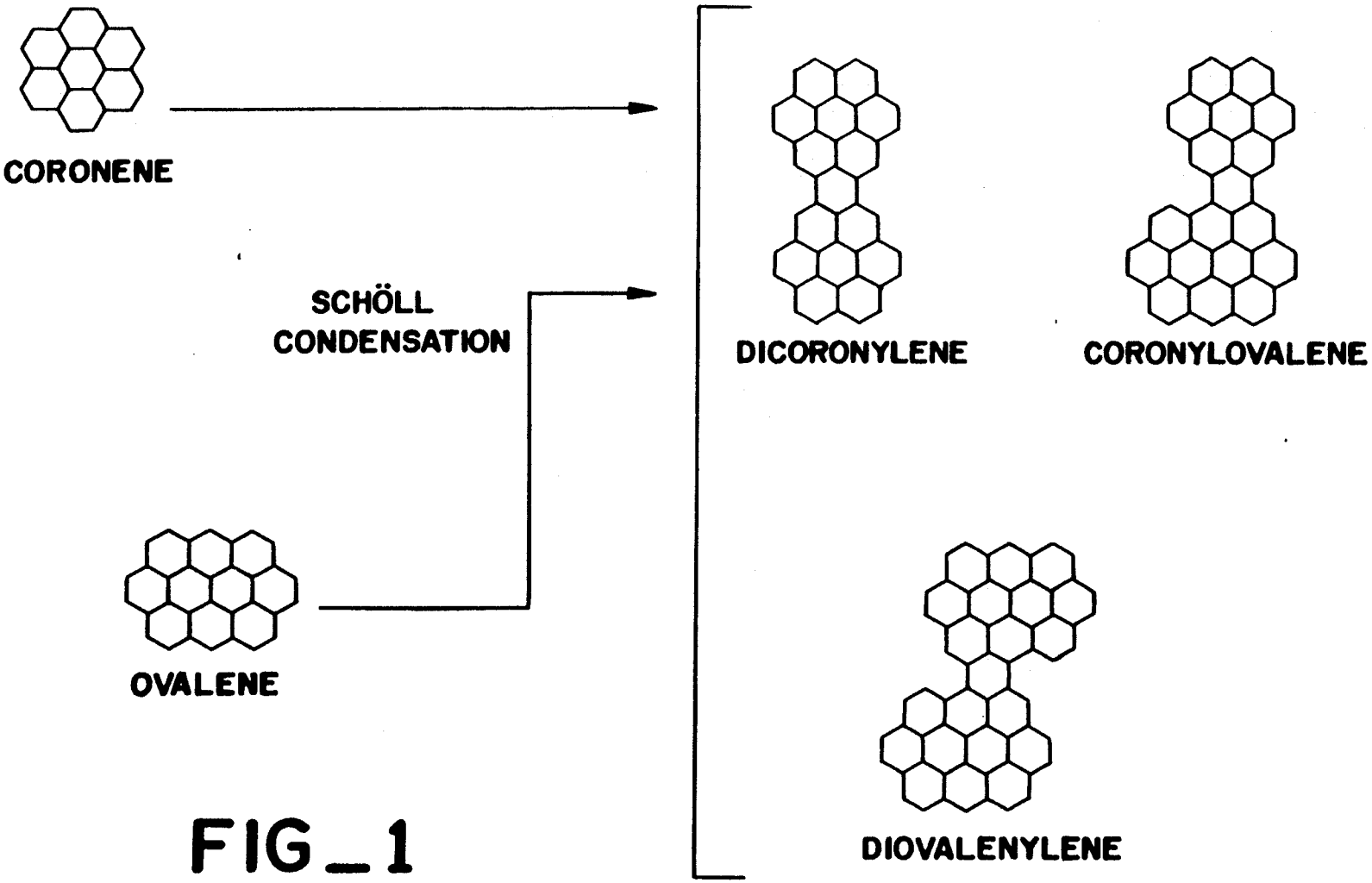
FIG. 1 is a representation of the chemical reaction creating the foulant stable polycyclic aromatic dimer compounds.
Figure 2:
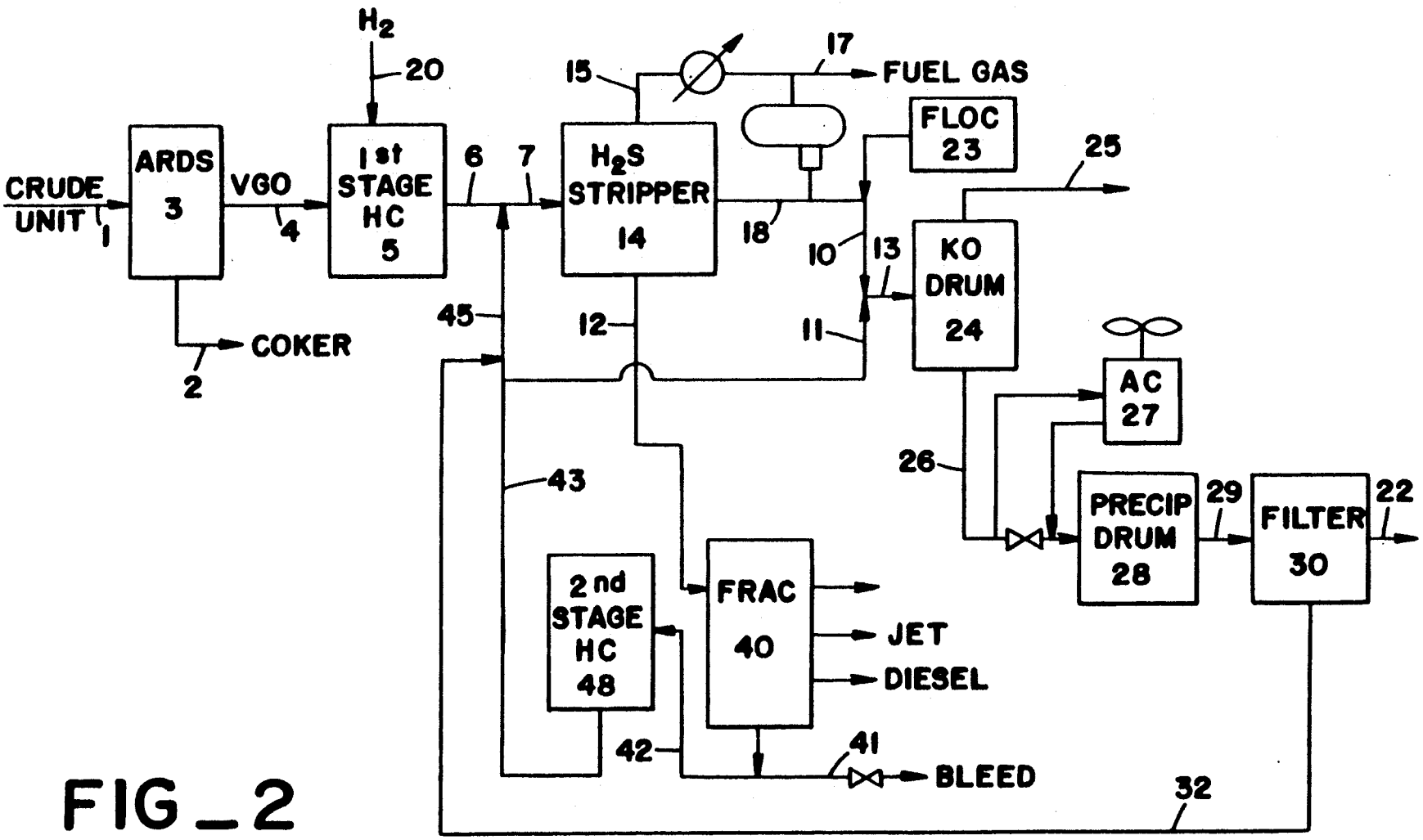
FIG. 2 is a schematic flow diagram illustrating a preferred embodiment of the present invention.

Hydrogen, in the form of net recycle hydrogen or makeup, is introduced to the process via line 20, and when compressed to produce pressure of about 750 psig to 10,000 psig, or typically 1,000 psig to 4,000 psig, is introduced with the hydrocarbonaceous feed to the first hydrogen conversion zone 5 of the two-stage hydrocracker. It should be noted that FIG. 2 is a simplified process diagram and many pieces of process equipment, such as separators, heaters and compressors, have been omitted for clarity. The temperature and pressure of the first hydrocracking reactor 5, which indicates process severity along with other reaction conditions, vary depending on the feed, the type of catalyst employed, and the degree of hydroconversion sought in the process. The effluent from the first hydroconversion reactor exits the first hydroconversion zone 5 via line 6 and passes to a Hydrogen Sulfide Stripper Zone 14 in one embodiment of the present invention, before passed to a fractionator or other downstream refining equipment via line 12.

In the preferred embodiment depicted in FIG. 2, the negative consequences of a foulant build-up was most prevalent, prior to our discovery, in the "recycle-loop portion" comprised in FIG. 2 of streams 42, 43 and 45. To control the rate of foulant accumulation in the recycle-loop, it was previously necessary to withdrawal or "bleed" a significant portion of the valuable recycle material, shown by stream 41 in FIG. 2. This bleed was typically blended off to fuel oil or sent to a coker.

In the process of the present invention, we have found it particularly advantageous to operate under the effluent stream 45 exiting from the second hydrocracker zone 48 to remove a portion of the polycyclic aromatic dimers which are foulant compounds having a propensity to drop out of liquid solution and plug downstream refinery equipment. Selective removal of the foulant stable polycyclic aromatic dimer compounds may be accomplished by filtration or other physical separation methods such as centrifugation or settling. It is first required, however, that the foulant compounds be selectively precipitated from the refinery liquid stream wherein they are contained.

We have achieved surprisingly good results in the selective precipitation of foulant polycyclic aromatic dimers when an amount of a paraffinic stream is added to the stream containing the PAD's, to form a blended stream. The paraffinic stream is mixed with the PAD containing stream in a mole ratio of between 1:10 and 1:2, preferably between 1:3 and 1:5. Due to the large difference in solubility of PAD's within the effluent stream from the second stage hydrocracker 48, shown here by line 43, and a paraffinic stream such as Hydrogen Sulfide Stripper reflux, shown in FIG 2 as line 10, precipitation can be accomplished by combining these streams. According to a preferred embodiment of the present invention, a paraffinic stream 10 is blended with hydrocarbonaceous stream 11 containing fouling stable polycyclic aromatic dimer compounds to form blended stream 13. In a preferred embodiment, the paraffinic stream is $H_2S$ stripper unit reflux. Other light streams such as fractionator condensate may be used.

Having now at least partially precipitated PAD's therein, stream 13 enters a separation zone, wherein at least a portion of the precipitated PAD foulant is removed from the process without disrupting on-stream hydrocracker operations. Preferably, blended stream 13 first enters a "knock-out" drum separator 24 and the liquid phase stream 26 from the knock-out drum is transferred to a precipitation drum 28 having, in this preferred embodiment, a residence time of about six hours. Prior to precipitation drum 28, additional cooling means, such as air cooler 27, may be employed to further aid in the controlled precipitation of foulant stable polycyclic aromatic dimer compounds. Transfer line 29 feeds filtration unit 30, which may preferably be a dual system allowing for continuous filtering operation. Stable polycyclic aromatic dimer precipitate is withdrawn and removed from the hydrocracking system via line 22 to a storage or disposal location. Stream 32 from the filtration unit 30 represents the return stream having a lower PAD concentration than extracted stream 11 or second stage hydrocracker effluent stream 43 due to PAD removal in the separation zone. It should be noted that preferred embodiment of the present invention is depicted in FIG. 2 with a two-stage hydrocracking process, though not so limited. In the separation zone, only a relatively small portion, on a mass basis, of the total blended stream 13 is removed from the process in the form of PAD precipitate. Excessive removal of hydrocarbon liquid, or "bleeding", as depicted by line 41, and which prior to this invention was commonly practiced, is significantly reduced or eliminated by employing the process of the present invention.

Filtered stream 32 now is transferred to downstream equipment or, in the example of the preferred embodiment, combined with the effluent of the second stage hydrocracker prior to the hydrogen sulfide stripping unit 14. Having sufficient quantity of PAD removed in the separation zone 20 to allow the liquid hydrocarbon material present in the exemplary process of FIG. 2 not to interfere with downstream refinery equipment is one of the principal objects of the present invention.

In an alternate preferred embodiment of the present invention, the blended stream 13 additionally contains flocculant added to stream 10 from flocculant stage location 23. The amount of flocculant added is in the range of between 100:1 and 20:1 by weight, relative to the amount of PAD present. We have had particularly good results when flocculant is added in the ratio of between 40:1 and 50:1. The precipitation of foulant PAD is often enhanced or accelerated, we have found, by the presence of such flocculant compounds as, for example, ethylene vinyl acetate copolymer or dicarboxylate terminated polystyrene. The addition of flocculant may enable a reduced addition of paraffinic material to achieve sufficient precipitation of PAD from the blended stream. We have found that a good flocculant is a compound molecular which has enough aliphatic character to be readily soluble in hydrocracker effluent, yet sufficient polar characteristics to interact with the PAD's. The other part of the molecule should be a chemical functional group or moiety which has a strong interaction with the dicoronylene or other PAD molecules. This can either be accomplished by a polar group or a group with a strong affinity for the pi electrons of the PAD molecule. There are several types of compounds that meet these criteria, especially polymers with long hydrocarbon chains and polar functionalities. The flocculant should be first diluted by mixing with the light paraffinic material prior to blending with the stream containing PAD to reduce light paraffinic stream requirements. This ensures a good distribution so that a greater proportion of the dicoronylene and other PAD molecules may be removed. Due to a typical temperature difference of around 300° F. between the effluent from the second stage hydrocracker in line 11 containing PAD and the paraffinic stream 10 blended therewith, the resulting blended stream 13 temperature is lower relative to that prior to blending with the paraffinic stream. We have found that a temperature drop of around 25° F.–100° F. achieves a desired enhancement of the precipitation of PAD, without excessive decrease in the thermal and overall efficiency of the hydrocracking refinery process. The blended temperature may be further cooled to optimize the precipitation of PAD either through controlling the rate of blending, or through employment of well known external cooling means such as heat exchangers. The degree of additional cooling will depend on refinery design and overall refinery heat balance, and will therefore be refinery specific.

In the process of the alternate preferred embodiment of the present invention, we have found it particularly advantageous to add flocculant in a ratio of between 40:1 and 50:1 on a mass basis relative to the determined amount of PAD present in the portion of blended stream subjected to the separation zone.

Typical concentrations of dicoronylene in fractionator bottoms 41 at one large refinery range between 30–70 parts per billion, depending on the bleed rate. Concentration of dicoronylene in reactor effluent stream 11 range between 50 and 200 parts per billion.

The following examples of various aspects related to the present invention are intended to help exemplify the invention, but are not intended to limit the invention in any manner.

EXAMPLE I—QUANTIFICATION OF PAD FOULANT

A deposit containing oil from a hydrocracker was obtained during a shutdown. This sample was stored two weeks and then treated by exhaustive extraction with dichloromethane using a Soxhlet extractor to give a deposit residue.

Spectrofluorescence was used to detect PAD's presence in the samples. Using a Perkin-Elmer Model MFP-66 spectrofluorometer with synchronous scanning, trace level mixtures of PAD's were measured without the need to separate them. The highest wavelength excitation and lowest wavelength emission maxima of these PADS differ by about 5–20nm. When both the excitation and emission monochromators of the spectrofluorometer were scanned synchronously with preset delta wavelength values, single spectral bands occurred for each PAD. In this manner, the other excitation bands that were farther than the delta value away from the lowest emission wavelength were not seen nor were emission bands that were farther than delta away from the highest excitation band.

The analysis of hydrocracker deposit residue remaining (after exhaustive extraction with dichloromethane) by mass spectrometry showed two homologous series with starting masses of 596 and 694. These were believed to be fusion products of two coronene molecules or a coronene and an ovalene molecule, respectively, yielding PADs named dicoronylene and coronylovalene. These assignments were strongly suggested because other isomers that might occur would have resulted from sequential one-ring additions. No other intermediate PADs were seen, so a series of one-ring additions is unlikely.

A saturated solution of the deposit residue in 1,2,4-trichlorobenzene (TCB) was prepared and examined by field desorption mass spectrometry and spectrofluorescence. The spectral characteristics of pure dicoronylene and the hydrocracker residue were examined. Comparison excitation spectra of the two showed almost identical patterns, except that the pattern for the residue was shifted to slightly higher wavelengths due to alkyl substitution.

For synchronous scanning fluorescence (SSF), a delta value of 6 nm was used, since this was found to be the band difference for a solution of pure dicoronylene. This delta value necessitated monochrometer slit widths of 2 nm. A saturated solution was too concentrated for direct analysis, so a standard solution was prepared. In order to obtain a solution that was dilute enough, 345 micrograms was weighed on a microbalance and dissolved in 500 ml TCB. Five milliliters of this solution was then diluted to 1:100.

The synchronous scan of this solution showed two major peaks: the first, centered at 510 nm, is due to the dicoronylene and the second peak, centered at 545 nm, is believed to be due to the coronylovalene. (The ratio of these two peaks is approximately the proportion seen for the total concentration of these classes reported by mass spectrometry.) A more concentrated sample showed an additional peak at 610 nm which is most likely due to "diovalenylene" from the condensation of two ovalene molecules.

Duplicate samples of a hydrocracker feed and a hydrocracker recycle oil were synchronously scanned. The feed samples did not show a distinct peak in the spectral range that is characteristic for dicoronylenes, but the recycle oil samples did. The sample concentrations in TCB used were 1.0 g/10 ml for the feeds and 0.1 g/10 ml for the recycle oils. When the recycle oil peaks are compared to the deposit "standard", the concentrations for dicoronylenes in the first sample is 70 parts-per-billion (ppb) and 85 ppb for the second sample.

EXAMPLE II—ADDING A LIGHT PARAFFINIC

Two types of experiments were run to determine the amount of dicoronylene removed from solution by adding a poor or anti-solvent, in this case a paraffinic solvent. The first experiment, to confirm the underlying principles of the discovery, involved preparing a saturated sample by adding some solid dicoronylene powder (obtained from purification of a hydrocracker deposit material) to a hydrocracker recycle oil. 200 milliliters aliquots were heated on a hot plate to about 400° F. Different amounts of a 1:1 of mixture of n-pentant and 2-methylbutane were added and the solutions were allowed to stand for 1 hour (at 400° F.). Samples of the oil were then taken and analyzed by synchronous-scanning fluorescence (SSF) for dicoronylene. The amounts of dicoronylene removed were calculated by taking the measured amounts and allowing for the dilution due to the pentane mixture addition.

The amounts of pentane solution (volume ratios) and the amount of dicoronylene remaining are shown below in Table I.

TABLE I

| | Dicoronylene Solubility[1] (in ppb) | | | |
|---|---|---|---|---|
| | Volume Ratios (Oil:Pentanes) | | | |
| Temp (°F.) | Neat[2] | 5:1 | 3:1 | 2:1 |
| 200 | 65 | 10 | 7 | 7 |
| 250 | 90 | 20 | 16 | 13 |
| 300 | 155 | 35 | 24 | 22 |
| 350 | 215 | 60 | 52 | 44 |
| 400 | 280 | 90 | 79 | 68 |

[1]1:1 mixture n-pentane and 2-methylbutane used as anti-solvent.
[2]Amount of dicoronylene in a saturated solution.

TABLE II

| | Dicoronylene Removal @ 400° F. | | |
|---|---|---|---|
| Expt. No. | Vol of Sat. Cycle Oil | Vol of Pentane Mixture, ml. | Dicoronylene Removed, % |
| 1 | 200 ml. | 50 | 70 |
| 2 | 200 ml. | 100 | 76 |
| 3 | 200 ml. | 200 | 87 |
| 4 | 200 ml. | 400 | 99 |

The second procedure further involved an in situ filtration step. The filtration apparatus was a metal vessel approximately 500 milliliters in volume. Also, it was jacketed so that it could be heated. The filtration disk was at the bottom and contained a 10 micron filter. Pressure could be applied using an inlet to a nitrogen line at the top. The pressure was increased to force out a sample, which was then analyzed by SSF. In further defining the solubility range of dicoronylene, various volumes of the n-pentane,2-methylbutane mixture were added to an oil sample containing dicoronylene. All runs were at 400° F. The effectiveness in removal of dicoronylene is shown in Table II.

EXAMPLE III

The solubility of dicoronylene was determined by saturating samples of three separate refinery streams with dicoronylene at temperatures ranging from 200°–400° F. Because of the difficulty in filtering these oils at the higher temperatures, we simply decanted samples of the oils, leaving solid dicoronylene in the bottom of the flasks. We then determined the dissolved dicoronylene in the supernatant oil samples using spectrofluorescence.

There are big differences in the solvation power of the three refinery streams: the Hot Low Pressure Separator (HLPS) bottoms, the $H_2S$ stripper bottoms, and the fractionator bottoms (the recycle liquid). We found that dicoronylene was almost a factor of 10 times more soluble in the $H_2S$ stripper bottoms than in the HLPS bottoms. The major difference in the two streams is the presence of light hydrocarbons in the HLPS bottoms. These light hydrocarbons, mostly paraffins, are separated along with the $H_2S$ in the stripper. These paraffinic materials greatly reduce the solvation power of the stripper bottoms for PAD's.

EXAMPLE IV—FLOCCULANTS

To see if a chemical flocculant could aid in removing PAD's, we carried out some screening tests. In these tests, samples of a second-stage recycle oil (fractionator bottoms) which had been saturated with dicoronylene at 100° F. were treated with small amounts of flocculants, i.e., oil-soluble polymers. The polymers tested included polyvinylacetate, ethylene vinyl-acetate copolymer, poly(2-vinyl)pyridine/-styrene copolymer, and dicarboxylate-terminated polystyrene. Without cooling these samples, 100 ppm doses of polymer caused the dissolved PAD's to precipitate and flocculate into large, visible flocs with diameters as large as a few mm. In these tests, we were able to reduce the dicoronylene concentration from about 2,000 ppb to about 20 ppb and, in addition, precipitate 50–80% of the coronene in the samples. Although some of the polymers produced bigger and denser flocs than others, they were all effective at enhancing flocculation of PAD's.

Resulting dicoronylene concentrations from an original sample concentration of about 2,000 ppb are shown below in Table III.

TABLE III

| Flocculant Studies[1] | |
|---|---|
| Polyvinylacetate (PVA) | 130 ppb |
| Ethylene/PVA Copolymer | 125 ppb |
| Poly(2-vinyl)pyridine/styrene copolymer[2] | 245 ppb |
| Dicarboxylate-terminated polystyrene | 20 ppb |
| Poly(butyl methacrylate/iso-butyl methacrylate) copolymer | 180 ppb |
| Polyvinylmethylether | 235 ppb |
| Poly(2-vinyl)pyridine | 250 ppb |

[1]Original dicoronylene concentration was 2,000 ppb.
[2]Floc was very finely suspended.

At significantly lower concentrations, chemically induced precipitation might not be as effective.

EXAMPLE V

This experiment shows that filtration, in concert with thermally or chemically induced precipitation, can lower the concentration of PAD's in the HLPS bottoms.

For these tests, we used a very small sample of HLPS bottoms from a refinery. This liquid was saturated with dicoronylene at 415° F. We maintained the hot oil under a nitrogen blanket for about 24 hours to establish an equilibrium between the dissolved and solid chunks of dicoronylene. During this time, the oil darkened somewhat due, apparently, to oxidation. This oil, saturated at 415° F., was intended to represent a worst case for the oil coming out of the HLPS. The concentration of PAD's in the oil was about 120 ppm.

Next, 4–50 ml samples of this dicoronylene-saturated oil were filtered using a small batch pressure filter. We wrapped the body of the filter with heating tape and used a temperature controller to maintain temperatures within a few degrees of our targets. The filter media consisted of 47 mm diameter Teflon membrane filters with average pores of 10 microns. On top of the membranes, we placed a glass fiber prefilter to more closely simulate the filtering environment of a woven cartridge filter and to reduce the tendency of the membrane filter to blind.

The flocculant used in two of these tests was a dicarboxy-terminated polystyrene, predissolved in a high-boiling cut of light cycle oil. Following are descriptions of the four samples:

1. This sample was cooled from 415°–275° F. in about 5 minutes and filtered. No flocculant added.
2. We added 100 ppm of flocculant to the sample, cooled it from 415°–275° F. in about 5 minutes and filtered.
3. This sample was cooled from 415°–275° F. in about 5 minuets, held at 275° F. for 25 minutes and filtered, without flocculant added.
4. Again, we added 100 ppm flocculant to the sample, cooled from 415°–275° F., held at 275° for 25 minutes and filtered.

At 275° F. and with differential pressures of only 2–3 psi, the samples all filtered in less than a minute. With such rapid filtering, we obviously didn't need the glass fiber prefilters in these tests.

Spectrofluorescence of the filtrates showed the following dicoronylene concentrations:

1. 25 ppb.
2. 20 ppb.
3. 25 ppb.
4. 35, 45 ppb (determined twice).

We don't understand the result of sample 4. There could have been some bypassing of the filter element, either due to a hole or tear in the membrane filter or due to the membrane not resting properly on its seating surface. (The result of 4 is close to the value previously determined for the solubility of dicoronylene in HLPS at 275° F. of about 45 ppm.)

These results show an extra 25 minutes residence time of tests 3 and 4 didn't seem to improve the amount of PAD's removed. It should be noted, however, that the darkening of the oil by heating at 415° F. may have affected the solubilizing power of the HLPS liquid, or the ability of the polymer to precipitate the PAD's.

These experiments show that we can reduce the concentration of dicoronylene in the HLPS liquid to about half of its original value using cooling and filtration, and perhaps a little more by cooling and using flocculants.

EXAMPLE VI

Method Applied to Refinery Process

Vacuum gas oil having a boiling point in the range 650°-1100° F. from a residual desupherization unit is fed to a hydrocracking reactor (Hydrocracker). Heavy effluent from the hydrocracker is fed to a $H_2S$ stripper where an overhead product comprising $C_5$ and lighter liquid paraffinics are condensed in an overhead condenser before refluxing back to the $H_2$stripper. 500 BPD pentane mixture is blended with 1000 barrels per day of a heavy effluent (at 415° F.) from a second stage hydrocracker having polycyclic aromatic dimers present. The blended stream is fed to a knock-out drum operating at 325° F. and 180 psig. Liquid phase from the knock-out drum flows to a precipitation drum having a residence time of six hours. From the precipitation drum the fluid flows to a filtration unit where the precipitant is filtered on-line using a dual filter system. To induce precipitation and accumulation of the stable polycyclic aromatic dimer, a flocculating agent is added upstream of the knock-out drum. A fin-fan-type air cooler is installed between the knock-out drum and precipitation drum to contribute additional cooling and induce additional precipitation, and the cooler is operated dependent upon the amount of dimer present according to a spectro chemical analysis. At the filter unit, dimer precipitate is removed to a storage or disposal location. The clean liquid from the filtration unit is returned to the heavy effluent stream from which the 1000 BPD at 415° F. stock was obtained.

The cleaning of stable polycyclic aromatic dimer from the heavy effluent stream in this example eliminates the bleed stream requirement of 2000 BPD from the fractionator bottoms in order to reduce the build-up of such foulants in the system. Thus, a greater quantity of hydrocracked material is ultimately converted to valuable jet, diesel and other products in the fractionator, and produces an overall increase in product revenue.

Summary economics for this example are shown below. A net savings of over $60,000 per day is realized from a capital investment of $750,000, constituting the separation and filtrate removal equipment described above.

TABLE IV

| Hydrocracker Economics With Maximum Jet Production[1] | | | | | |
|---|---|---|---|---|---|
| | Base with Bleed[2] | | | Case with Added Flocculant[3] | |
| | Index $/B | MBPOD | MS/D | MBPOD | MS/D |
| Products | | | | | |
| Naphtha | 28.00 | 13.2 | 369.6 | 13.2 | 369.6 |
| Jet | 33.00 | 28.9 | 953.7 | 30.9 | 1019.7 |
| $H_2$ Losses[4] | 4.00 | 2.0 | 6.8 | — | 0.0 |
| Total Revenues | | | 1330.1 | | 1389.3 |
| Incr. Op. Costs MS/OD | | | | | |

TABLE IV-continued

| Hydrocracker Economics With Maximum Jet Production[1] | | | | | |
|---|---|---|---|---|---|
| | Base with Bleed[2] | | | Case with Added Flocculant[3] | |
| | Index $/B | MBPOD | MS/D | MBPOD | MS/D |
| Flocculant[5] | | | — | | 0.2 |
| PCA Cleanup[6] | | | 3.6 | | — |
| Revenues-Op Costs | | | 1326:5 | | 1389.1 |
| Summary | | | | | |
| Daily Savings MS/day | | | — | | 62.6 |
| Inventment MS | | | — | | 750.0 |
| Payout Period (days) | | | — | | 12.0 |

[1]40 MBPOD mid-distillate hydrocracker
[2]2 MBPOD bleed to control PCA formation
[3]Filtration of 5 MBPOD: no incremental manpower or utility costs
[4]850 SCF/B due to hydrogenation of fuel oil components; $4/1000 SCF $H_2$
[5]100 ppm flocculant at $1.25/lb., no added cooling.
[6]Due to down time on hydrocracker to clean up PAD deposit (3 incremental shutdown days)

Additional modifications and improvements utilizing the discoveries of the present invention that are obvious to those skilled in the art from the foregoing disclosure and drawings are intended to be included within the scope and purview of the invention as defined in the following claims.

What is claimed is:

1. A process for selectively removing stable polycylic aromatic dimers present in hydrocracker effluents from a hydrocarbonaceous feedstock comprising:
   (a) feeding a hydrocarbonaceous feedstock to a hydrocracker to produce a light effluent stream and a heavy effluent stream comprising lighter polynuclear aromatics and stable polycyclic aromatic dimers;
   (b) contacting at least a portion of the heavy effluent stream with a light paraffinic stream to precipitate a majority of the stable polycyclic aromatic dimer and maintain in solution a majority of the lighter polynuclear aromatics to produce a blended stream containing polycyclic aromatic dimer precipitate; and
   (c) separating and withdrawing from the blended stream at least a portion of the precipitate containing stable polycyclic aromatic dimer while the hydrocracker is on-stream.

2. A process in accordance with claim 1 wherein the hydrocarbonaceous feedstock is vacuum gas oil.

3. A process in accordance with claim 1 wherein the hydrocarbonaceous feedstock has been contacted with a desulferization catalyst prior to the hydrocracking reactor.

4. A process in accordance with claim 1 wherein the separating step comprises filtration.

5. A process in accordance with claim 1 wherein the hydrocracking reactor is a fixed-bed reactor.

6. A process in accordance with claim 1 wherein the hydrocracker is a two stage hydrocracker having a first stage and a second stage and further wherein an $H_2S$ stripping unit is disposed between the first stage and the second stage, said $H_2S$ stripping unit having as a stripping feedstream at least a portion of the effluent produced in the first stage of the two stage hydrocracker to produce an overhead stream and wherein the light paraffinic stream is at least a portion of the overhead stream derived from the H2S stripping unit.

7. A process in accordance with claim 5 wherein the hydrocracker comprises a first stage reactor and a second stage reactor and wherein the heavy effluent stream is at least a portion of the bottom effluent recycle stream derived from the second stage of the two stage hydrocracker.

8. A process in accordance with claim 1 wherein prior to the contacting step, the paraffinic stream is sub-cooled.

9. A process in accordance with claim 1 wherein the polycyclic aromatic dimer is selected from the group consisting of dicoronylene, coronylovalene, diovalylene, or mixtures thereof.

10. A process for removing stable polycyclic aromatic dimers comprising:

(a) feeding a hydrocarbonaceous feedstock to a hydrocracking reactor to produce a light effluent stream and a heavy effluent stream;

(b) contacting at least a portion of the heavy effluent stream with a light paraffinic stream to produce a blended stream containing polycyclic aromatic dimer precipitate;

(c) adding a flocculating agent to the blended stream; and (d) separating and withdrawing from the blended stream.

11. A process in accordance with claim 10 wherein the flocculating agent is selected from the group consisting of vinyl acetate copolymer, dicarboxylate-terminated polystyrene, and poly-vinylacetate.

12. A process in accordance with claim 10 wherein the flocculating agent is first mixed with an amount of light paraffinic stream to dissolve the agent in the heavy effluent stream.

13. A process in accordance with claim 10 wherein the flocculating agent is mixed with the light paraffinic stream prior to contact with the heavy effluent stream.

14. A process in accordance with claim 10 wherein the flocculating agent is added to the blended stream prior to separation of the precipitate from the blended stream.

15. A process in accordance with claim 10 wherein the separating step comprises filtration.

16. A process in accordance with claim 10 wherein the separating step comprises centrifugation.

17. A process in accordance with claim 10 wherein the separating step comprises settling of the blended stream.

18. A process in accordance with claim 10 wherein separation occurs by deposition of the precipitate onto surfaces provided to allow for polycyclic aromatic dimer accumulation and which allow for periodic removal of the precipitate while the hydrocracker is on-stream.

19. A process in accordance with claim 10 wherein the flocculating agent is added in a ratio of between 100:1–20:1 in relation to the determined amount of PAD present in the blended stream.

20. A process in accordance with claim 10 wherein the hydrocarbonaceous feedstock effluent stream is vacuum gas oil.

21. A process in accordance with claim 10 wherein the light paraffinic stream is process condensate from a fractionator.

22. A process in accordance with claim 10 wherein the light paraffinic stream is cooled prior to blending with the heavy effluent stream.

23. A process in accordance with claim 7 wherein the heavy effluent stream subjected to the contacting and separating steps is a portion of a total bottom effluent stream from the second stage of a two-stage hydrocracker.

24. A process in accordance with claim 10 wherein the heavy effluent stream is selected from the group consisting of coker gas oil, heavy cycle oil and medium cycle oil.

* * * * *